US011123780B2

(12) United States Patent
Yuan et al.

(10) Patent No.: US 11,123,780 B2
(45) Date of Patent: Sep. 21, 2021

(54) DEVICE AND METHOD FOR ACHIEVING CORE PART PRESS-DOWN TECHNOLOGY IN CONTINUOUS CASTING ROUND BILLET SOLIDIFICATION PROCESS

(71) Applicant: Northeastern University, Shenyang (CN)

(72) Inventors: Guo Yuan, Shenyang (CN); Jian Kang, Shenyang (CN); Yan Zheng, Shenyang (CN); Zhenlei Li, Shenyang (CN); Guanglin Jia, Shenyang (CN); Guodong Wang, Shenyang (CN)

(73) Assignee: Northeastern University, Shenyang (CN)

( * ) Notice: Subject to any disclaimer, the term of this patent is extended or adjusted under 35 U.S.C. 154(b) by 0 days.

(21) Appl. No.: 16/646,019

(22) PCT Filed: Feb. 27, 2019

(86) PCT No.: PCT/CN2019/076218
§ 371 (c)(1),
(2) Date: Mar. 10, 2020

(87) PCT Pub. No.: WO2020/155264
PCT Pub. Date: Aug. 6, 2020

(65) Prior Publication Data

US 2020/0261955 A1 Aug. 20, 2020

(30) Foreign Application Priority Data

Feb. 1, 2019 (CN) ..... 201910104222.0

(51) Int. Cl.
*B22D 11/128* (2006.01)
*B22D 11/126* (2006.01)
*B21B 1/46* (2006.01)

(52) U.S. Cl.
CPC ..... *B21B 1/463* (2013.01); *B22D 11/126* (2013.01); *B22D 11/1287* (2013.01)

(58) Field of Classification Search
CPC . B22D 11/126; B22D 11/128; B22D 11/1287; B22D 11/207; B21B 1/46; B21B 1/463
(Continued)

(56) References Cited

FOREIGN PATENT DOCUMENTS

CN 1331616 A 1/2002
CN 200957426 Y 10/2007
(Continued)

OTHER PUBLICATIONS

Machine translation of CN 206839078 U (Year: 2018).*

*Primary Examiner* — Kevin P Kerns
(74) *Attorney, Agent, or Firm* — Muncy, Geissler, Olds & Lowe, P.C.

(57) ABSTRACT

A device for achieving a core part press-down technology in a continuous casting round billet solidification process includes a plurality of round billet radial press-down devices distributed along an axial array of round billets outside a press-down interval of the round billets. The press-down interval is an area from 0.65 of a solid phase ratio of the round billets to solidification end points. Each round billet radial press-down device includes a plurality of press-down rollers. A forming hole for extruding the round billets is formed between the press-down rollers. Two adjacent round billet radial press-down devices are arranged in the manner of staggering. The device can effectively solve the defect problems of porosity, segregation and the like in the core of the continuous casting round billets, the yield of the continuous casting round billets is increased, and the production cost is reduced.

10 Claims, 10 Drawing Sheets

(58) Field of Classification Search
USPC ..... 164/459, 476, 417, 424; 29/527.7
See application file for complete search history.

(56) References Cited

FOREIGN PATENT DOCUMENTS

| | | | | | |
|---|---|---|---|---|---|
| CN | 103706634 | A | | 4/2014 | |
| CN | 104001891 | A | | 8/2014 | |
| CN | 203992296 | U | | 12/2014 | |
| CN | 102728613 | B | | 2/2015 | |
| CN | 104353672 | A | | 2/2015 | |
| CN | 104858383 | A | | 8/2015 | |
| CN | 104874758 | A | | 9/2015 | |
| CN | 106001476 | A | | 10/2016 | |
| CN | 106141127 | A | | 11/2016 | |
| CN | 106735026 | A | | 5/2017 | |
| CN | 107537987 | A | | 1/2018 | |
| CN | 206839078 | U | * | 1/2018 | ..... B22D 11/12 |
| CN | 108067501 | A | | 5/2018 | |
| JP | 2015077615 | A | | 4/2015 | |

* cited by examiner

DEVICE AND METHOD FOR ACHIEVING CORE PART PRESS-DOWN TECHNOLOGY IN CONTINUOUS CASTING ROUND BILLET SOLIDIFICATION PROCESS

BACKGROUND OF THE INVENTION

1. Field of the Invention

The present invention relates generally to metal material forming and control engineering, and more particularly, to provide a device and method for achieving a core part press-down technology in a continuous casting round billet solidification process.

2. The Prior Arts

Continuous casting round billets are important billets for development and production of seamless steel pipes, offshore platform leg piles, large flanges, bearings and other steel products. Due to the low-casting-speed casting of continuous casting round billets, the solidification speed of molten steel is low, columnar crystals in the round billet structure are developed, and dendrite overlapping is easy to occur, so that the internal segregation, porosity and shrinkage cavity of continuous casting round billets, especially large diameter billets, are more serious.

Defects such as segregation, porosity and shrinkage cavity of continuous casting round billets will lead to cracks, pits and the like in rolled pipes or processed offshore platform leg piles, large flanges, bearings and other products. Elements such as carbon and manganese are enriched in the continuous casting round billets to form segregation, which will form obvious banded structures in the casting billets, and the banded structures cause delamination in the billets, so that the mechanical properties of the billets in the radial direction and the axial direction are different. Regarding the continuous casting round billets for producing steel pipes, central segregation will lead to the uneven composition of the round billets during piercing and rolling, resulting in great difference in mechanical properties. Secondly, during the pipe billet piercing, the phase change of the banded structure in the center enables the local hardness to be increased, and difficulty of wall thickness control in the piercing process to be increased, enables that the wall thickness accuracy cannot be guaranteed, and causes uneven wall thickness. Besides, inclusions such as MnS and CaS, which are formed by center segregation in the center of the pipe billets, will enhance the sensitivity of the center of the billets to cracks, accelerate the crack propagation, and then easily cause defects in the process of processing and forming. In addition, round billets, especially large diameter round billets, are affected by defects such as internal porosity and shrinkage cavity caused by the shrinkage of molten steel during solidification, and defects such as tearing, cracks and even serious misrun and pits on the inner wall will occur during subsequent rolled pipes or processed offshore platform leg piles, large flanges, bearings and other products. Defects such as porosity and shrinkage cavity will enable the yield of continuous casting round billets to be reduced and the production cost to be increased.

In view of the above problems, technologies such as melt purification, low superheat pouring, electromagnetic stirring, and soft press-down at the solidification end are effective means developed or known in the industry to reduce center segregation or porosity and shrinkage cavity, which can improve billet quality to a certain extent, but defects such as porosity and segregation can also exist.

Melt purification can effectively prevent central segregation and porosity by smelting clean steel by using technologies of molten iron pretreatment or ladle desulfurization to reduce the content of S, P and other easily segregated elements in molten steel and improve the purity of molten steel. However, it has no effect on the defects of porosity and segregation caused by solute redistribution and liquid steel flow and volume shrinkage during solidification.

According to the low superheat casting technology, the superheat of molten steel is reduced in the continuous casting process, the casting temperature is low and the equiaxed crystal of the casting billets is developed, which can prevent the occurrence of center segregation and porosity. However, low superheat casting has certain limits in the process of the continuous casting process, otherwise it will bring many adverse effects on the continuous casting process.

Previously, the electromagnetic stirring technology developed and used in the solidification process of continuous casting billets can improve the surface and center quality of billets to a certain extent, but influence of the electromagnetic stirring technology on the solidification center quality of large-sized continuous casting round billets is limited, and reduction of defects such as porosity and segregation in the center of round billets is not obvious, as shown in FIG. 1.

In addition, use of the electromagnetic stirring technology in the continuous casting process can cause formation of white bands with negative segregation. The soft press-down technology at the solidification end in the continuous casting solidification process is limited by the small deformation of round billets, and deformation is difficult to penetrate into the center of billets and cannot compensate the solidification shrinkage of the continuous casting billets.

In the process of rolling large-sized round billets with high alloy composition, in order to solve the problems of segregation, porosity and the like in the center, the centers of the round billets are often removed by drilling and other manners. The round billets after being drilled are as shown in FIG. 2.

In the large press-down process at the solidification end, pressure is applied in the solidification process of the tube billets after the tube billets exist from a crystallizer until the solidification ends. Through large press-down quantity, deformation can penetrate into the center, improve the flow state of molten steel, increase the central compactness of the tube billets, and achieve the process effect of reducing defects such as central segregation and porosity of the continuous casting billets.

In order to improve the quality of billets, a solidification process or a large press-down process at solidification end is used in the continuous casting process of plate billets and square billets in steel industry. However, the solidification process, technical characteristics and press-down deformation mode of the continuous casting round billets required in the fields of seamless steel pipes, offshore platform leg piles, large flanges, bearings and the like are fundamentally different from those of plate billets and square billets due to the difference in billet shape, and the current process method and equipment of large press-down during continuous casting of plate billets and square billets cannot be used.

In the aspect of large press-down at the solidification end of continuous casting square billets and rectangular billets, patent CN108067501A discloses roll profile design of a rolling mill work roll used for the high-temperature large press-down process of large square billets and rectangular billets, and the core is that the work roll optimally combines the flange roll profile with box-type hole profile. After the composite roll-type work roll is applied to the high-temperature large press-down rolling process at the end of large square billets and rectangular billets, shrinkage cavity and compression effects of the flange roll in the thickness and extension directions and the box-type hole profile in the width direction can be highlighted simultaneously. Therefore, the deformation permeability of the core part of the casting billets and the three-way press-down effect of the central shrinkage cavity in single pass high-temperature large press-down rolling deformation are improved to a greater extent. It is characterized in that a special composite roll mill is used to carry out large press-down at a single position in single pass at the solidification end, and the press-down rate is 30-40% at the maximum, so as to realize the hot core and liquid core high-temperature large press-down rolling process with the solid phase ratio of 0.75-1 at the core of the casting billets.

Because continuous casting round billets, especially continuous casting large round billets, need multi-point continuous press-down in areas with high liquid phase ratio, i.e. not only press-down at the solidification end (as mentioned above, press-down only at the solidification end can no longer meet the multi-point press-down requirement necessary for low solidification speed of molten steel caused by low casting speed of round billets), but only large press-down at a single press-down position point in single pass and of a single stand cannot meet the process requirement of continuous or multi-point press-down at multiple positions of continuous casting round billets. The press-down quantity of 30-40% press-down rate cannot meet the requirement of continuous casting round billets with total press-down rate being 40% or above. Besides, the hole profile obtained by combination of flange roll profile and box-type hole profile is suitable for square billets or rectangular billets, but cannot meet the forming requirements of round sections of the round billets, and is not suitable for the shape characteristics of round billets. In addition, when continuous casting round billets, especially continuous casting large round billets, need to be continuously pressed down at multiple points in areas with high liquid phase ratio, multiple hole profiles of a plurality of press-down devices need to integrally cooperate mutually, the middle arc triangular hole profile and the flat triangular hole profile can be pressed down at a large press-down quantity under the press-down of a three-roller device, and the circular hole profile can meet the requirements of forming round sections of the round billets. Only when the arc triangular hole profile, flat triangular hole profile and circular hole profile cooperate for use together, the core part press-down technology in a continuous casting round billet solidification process can be realized. In a two-roller press-down device, the elliptical hole profile can be pressed down with a large press-down quantity, and the circular hole profile can meet the forming requirements of the round sections of the round billets. Only when the elliptic hole profile and the circular hole profile cooperate for use together, the core part press-down technology in a continuous casting round billets solidification process can be realized. The press-down devices described in patent CN108067501A need to cooperate organically for use. The use of a single press-down device cannot meet the technological requirements of the core part press-down technology in a continuous casting round billet solidification process, i.e. not only the press-down requirements but also the forming requirements of the round section shape of the continuous casting round billets should be met. Therefore, large press-down of only single hole profile at a press-down position point in single pass or the single press-down device, does not and cannot realize multiple press-down or the cooperation of the forming shapes after press-down, and cannot meet the requirements of forming round sections of continuous casting round billets, especially continuous casting large round billets, with large press-down process.

Therefore, patent CN108067501A cannot meet the large press-down process requirements of continuous casting round billets which need to be pressed down at multiple positions, and need to be provided with a plurality of press-down devices organically cooperating for multi-point press-down, and have a solid phase ratio less than 0.75.

The present invention relates to a method and device for achieving a core part press-down technology in a continuous casting round billet solidification process, wherein the press-down process is carried out in the range from the solid phase ratio fs=0.65 of the section of the round billets to the solidification end point. The press-down rate (or equivalent press-down rate) of each press-down device is in the range of 5%-40%, and the total press-down rate (or equivalent press-down rate) of the device for achieving a core part press-down technology in a continuous casting round billet solidification process reaches a total press-down quantity of 10%-60%. The press-down process uses continuous press-down at multiple positions in the running direction of the round billets. In one embodiment, each press-down device consisting of two press-down rollers forms a substantially closed elliptic or circular hole profile, and two adjacent press-down devices are staggered by 90 degrees. In another embodiment, each press-down device consisting of three press-down rollers forms a substantially closed circular hole shape of flat triangle or arc triangle, and two adjacent devices are staggered by 180 degrees. The present invention can meet the above requirements.

The cores of patent CN 106735026A, patent CN 106141127A, patent CN 104858383A, patent CN107537987A, patent CN104874758B, patent CN104001891A and patent CN 106001476A are used to press down the billets in the vertical direction (or the up-down direction of the plate billets and the square billets) in the solidification process of the plate billets or the square billets with rectangular cross section by using the pinch rolls on the upper and lower surfaces of the casting billets and the up-down pulling and straightening rollers on a pulling and straightening machine in the casting machine area, and the press-down position is to realize deformation of the plate billets and the square billets in a single direction. Press down of continuous casting round billets in the solidification process cannot be performed only from the vertical single direction, otherwise the forming requirements of the round sections of the round billets cannot be met.

Patent CN 106735026A provides a process for combining single-point large press-down at the end with continuous press-down. The process is characterized in that the continuous casting plate billets are performed by one to three sector segments, wherein the sector segments comprise five to seven pairs of pinch rollers, the first upper support roller of the sector segment is subjected to single-point press-down of 3-20 mm, the rest of the support rollers of the sector segment are subjected to press-down of 1-5 mm/m, and the implementation mode is that pinch rollers on the upper and lower surfaces of the plate billets of the sector segment of the plate billet continuous casting machine are vertically pressed down on the upper and lower surfaces of the plate billets. Similarly, press down of continuous casting round billets in the solidification process cannot be performed only from the vertical single direction, otherwise the forming requirements of the round sections of the round billets cannot be met.

Patent CN 106141127 A provides the process for heavy press-down by use of sector segments. It is characterized in that for the solidification process of the plate billets, a heavy press-down sector segment is arranged between two conventional sector segments, the heavy press-down sector segment is a sector segment arranged in the vertical direction of the plate billets, and the roller gap of the heavy press-down sector segment is reduced compared with the roller gap of a conventional sector segment, so as to provide high-quality plates. Similarly, press down of continuous casting round billets in the solidification process cannot be performed only from the vertical single direction, otherwise the forming requirements of the round sections of the round billets cannot be met.

Patent CN 104858383A provides a design scheme for heavy press-down sector segments. Segmental design is carried out for heavy press-down sector segments. The core of the design is to carry out segmented press-down deformation in the vertical direction of continuous casting plate billets. Obviously, it is also suitable for application of continuous casting plate billets.

Patent CN107537987A provides a convex combination roller and a heavy press-down process for large square billet production. A pulling and straightening roller is designed as a convex roller with a constant curvature and a boss convex roller with gradual curvature. The core is to use convex roller combination to vertically press down the upper and lower surfaces of the large square billets. Deformation only from a single direction cannot be used for pressing down in a continuous casting round billet solidification process, otherwise it cannot meet the forming requirements of round section of the round billets.

Patent CN104874758B provides a method and device for controlling continuous casting heavy press-down. The heavy press-down position is within the range from 0.6 of the solid phase ratio in the center of the casting billets to 1.5 m behind the solidification position, and is aimed at square billets of 180 mm multiply by 180 mm and 72A or 72B steel grade. Its core is that vertical press-down is performed on the upper and lower surfaces of the billets within the range from 0.6 of the solid phase ratio in the center of the casting billets to 1.5 m behind the solidification position. Similarly, deformation is only performed from one direction, which is suitable for continuous casting plate billets being in rectangular shape, and cannot be used for pressing down in the solidification process of continuous casting round billets, otherwise the forming requirements of the round section of the round billets cannot be met.

Patent CN104001891A provides an on-line control method for dynamic light press-down and heavy press-down of small square billets, the core of which is to remotely control the on-line light press-down and on-line heavy press-down amount of rollers on each pulling and straightening machine. The on-line control of the pulling and straightening machine simultaneously performs light press-down amount and heavy press-down amount, which is the vertical press-down of the upper and lower surfaces of the small square billets. Similarly, deformation from only one direction cannot be used for press-down during solidification of the continuous casting round billets, otherwise it cannot meet the forming requirements of round sections of the round billets.

Patent CN 106001476A provides a two-stage continuous dynamic heavy press-down method to overcome the defects of large square billets and wide and thick plates, which is characterized in that the large square billets and the wide and thick plates during solidification process are pressed down only on the upper and lower surfaces of the casting billets by using a pinch roller of sector segments or the upper and lower rollers of a straightening machine, and the press-down is performed in two stages.

Plate billet press-down and square billet press-down are significantly different from the metal rheological properties of round billet press-down, causing that the process and equipment methods cannot meet the requirements of the solidification process of round billets.

Patents CN102728613B, CN103706634A, CN104353672A and CN200957426 provide a rolling forming method for continuous casting billets that are solidified or even cooled to room temperature after a reheating process is performed. The core of the method is to heat and insulate the solidified round billets, then roll the completely solidified round billets with two-roll or three-roll rolling mills, and continuously roll the round billets through multiple rolling mills to obtain the finished products. In fact, the purpose of rolling is to reheat the continuous casting round billets after complete solidification or even after cooling to room temperature, mainly to reduce the diameter size of the round billets in shape and form the required rolled product with a certain diameter size. The key point is to change the size of the round billets, rather than conduct large press-down of the core of the round billets. In fact, in the heating process of the continuous casting billets, heat is conducted from the outside to the inside of the round billets, and the metal temperature of the outer layers of the round billets is greater than or equal to that of the core part. Therefore, press-down in the rolling process mainly realizes the deformation of the outer layers of the round billets without deformation of the cores. At the same time, due to limit by influence laws of properties of the lower the temperature of metals such as steel, the greater the deformation resistance and the like, the average temperature of round billets in the rolling process is lower than the average temperature in the solidification process of continuous casting billets, therefore, the deformation resistance in the rolling process is large, and the core press-down deformation effect obtained by the same press-down rate is much lower than that in the solidification process. Therefore, the deformation characteristic of rolling press-down is the deformation of the heated round billets, the interval is located behind the solidification point, instead of rolling in the range from the solid phase ratio fs=0.65 of the sections of the round billets to the solidification end point, the central liquid core of the continuous casting round billets is completely solidified, and the purpose of extruding, impacting and enriching solute molten steel and improving the flow of the molten steel to reduce central segregation cannot be achieved. Therefore, there is an essential difference from the large press-down process in the solidification process of continuous casting billets. Rolling after the solidification point obviously cannot meet the process target requirements for core part press-down in a continuous casting round billet solidification process. In addition, the bar rolling speed is high, the contact time between the rolled piece and the rolling mill is short, while the continuous casting round billets, especially the continuous casting large round billets, have low casting speed and long solidification time, and the contact time between the continuous casting round billets and the press-down device is long. Under the same conditions, the heat load of the press-down roller is obviously much higher than that of conventional bar rollers. A conventional bar rolling mill press-down device obviously cannot meet the technological requirements of continuous and uninterrupted press-down of the core part of the round billets in the solidification process of the continuous casting round billets. Finally, the liquid core of the continuous casting round billets is not completely solidified, in the process of achieving the core part press-down in the solidification process, the liquid core at the press-down position of the press-down roller is extruded and refluxed, and the flowing direction of the liquid core is opposite to the billet throwing direction. However, the liquid core is completely solidified in the process of bar rolling, and the flow direction of the metal in the core of the bar is the same as the rolling direction. The rolling process of the bar cannot meet the requirement of core part press-down in a continuous casting round billet solidification process. The processes and methods mentioned in the above patents cannot meet the requirements of the core part press-down process in a continuous casting round billet solidification process.

In view of this, the present invention proposes a device and method for achieving a core part press-down process in a continuous casting round billet solidification process.

SUMMARY OF THE INVENTION

A primary objective of the present invention is to provide a device and method for achieving a core part press-down technology in a continuous casting round billet solidification process.

The device for achieving a core part press-down technology in a continuous casting round billet solidification process comprises a plurality of round billet radial press-down devices distributed along an axial array of round billets outside a press-down interval of the round billets, and the press-down interval is an area from 0.65 of a solid phase ratio of the round billets to solidification end points. Each round billet radial press-down device comprises three press-down rollers distributed along a circumference of a central axis of the round billets in an array. A forming hole for extruding the round billets is formed between the three press-down rollers of each round billet radial press-down device. And the forming holes of the round billet radial press-down devices near forming ends of the round billets and the forming holes of the round billet radial press-down devices near solidification ends of the round billets are formed in a gradual change manner from a triangle to a circle. Two adjacent round billet radial press-down devices are arranged in a manner of staggering by 180 degrees. A water cutting plate is arranged at an outer side of each press-down roller, and a shape of the water cutting plate corresponds with a roller shape of each press-down roller. The press-down rollers of each round billet radial press-down device have a function of opening and closing along a radial direction of the round billets.

A total number of the round billet radial press-down devices are two to five.

Each press-down roller is made of heat-resistant steel.

As an alternate scheme of the device, a device for achieving a core part press-down technology in a continuous casting round billets solidification process comprises a plurality of round billet radial press-down devices distributed along an axial array of round billets outside a press-down interval of the round billets, and the press-down interval is an area from 0.65 of a solid phase ratio of the round billets to solidification end points (i.e. the solid phase ratio of the round billets is within the range of 0.65-1). Each round billet radial press-down device comprises two press-down rollers distributed along a circumference of a central axis of the round billets in an array. A forming hole for extruding the round billets is formed between the two press-down rollers of each round billet radial press-down device. And forming holes of the round billet radial press-down devices near forming ends of the round billets and the forming holes of the round billet radial press-down devices near solidification ends of the round billets are formed in a gradual change manner from an elliptic to a circle. Two adjacent round billet radial press-down devices are arranged in a manner of staggering by 90 degrees. A water cutting plate is arranged at an outer side of each press-down roller, and a shape of the water cutting plate corresponds with a roller shape of each press-down roller. The press-down rollers of each round billet radial press-down device have a function of opening and closing along a radial direction of the round billets.

A total number of the round billet radial press-down devices are two to five.

Each press-down roller is made of heat-resistant steel.

A method for achieving a core part press-down technology in a continuous casting round billet solidification process by using the aforementioned device for achieving the core part press-down technology in the continuous casting round billet solidification process, the method comprises the following steps:

Step 1: importing a material, a diameter and a casting speed of each of the round billets, a crystallizer water amount of a casting machine and a water amount of a secondary cooling zone into a finite element analysis software; determining a solid phase ratio at a beginning of press-down determined through a finite element analysis, and determining a starting position and an ending position of a press-down interval;

Step 2: running the round billets from an outlet of the casting machine to the round billet radial press-down devices along an axial direction of the round billets, when the round billets reach the round billet radial press-down devices, the round billets start to be pressed down by the round billet radial press-down devices, and after all the round billets pass through the round billet radial press-down devices, the press-down is stopped; and Step 3: spraying cooling water onto an outer surface of each press-down roller to cool each press-down roller during the press-down of the round billet radial press-down devices, and the cooling water after cooling flowing back to an equipment cooling water system of the casting machine along the water cutting plate of each press-down roller.

A press-down rate of a single round billet radial press-down device is 5%-40%, and a total press-down rate of the device for achieving a core part press-down technology in a continuous casting round billet solidification process is 10%-60%.

Compared with the prior art, the device and the method have the beneficial effects that:

At present, a conventional technique is applicable to large press-down of plate billets and square billets. The invention provides a device and method for achieving a core part press-down technology in a continuous casting round billet solidification process. Two to five round billet radial press-down devices with special hole profile are arranged in the continuous casting area (press-down interval) of the round billets, and a process method for performing radial press-down on multiple axial positions of the round billets is used, so that the average pass press-down rate can be 5%-40%, the total press-down rate is 10%-60%, the defects of porosity, segregation and the like in the core of the continuous casting round billets can be effectively overcome, the yield of the continuous casting round billets is increased, and the production cost is reduced. Besides, each round billet radial press-down device has the functions of lifting, opening and closing to meet the press-down requirements of round billets with different diameters. Through structural design of each round billet radial press-down device with a water cooling device, the damage of high temperature to each press-down roller is reduced, the service time of each press-down roller is prolonged, and the production cost is reduced.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
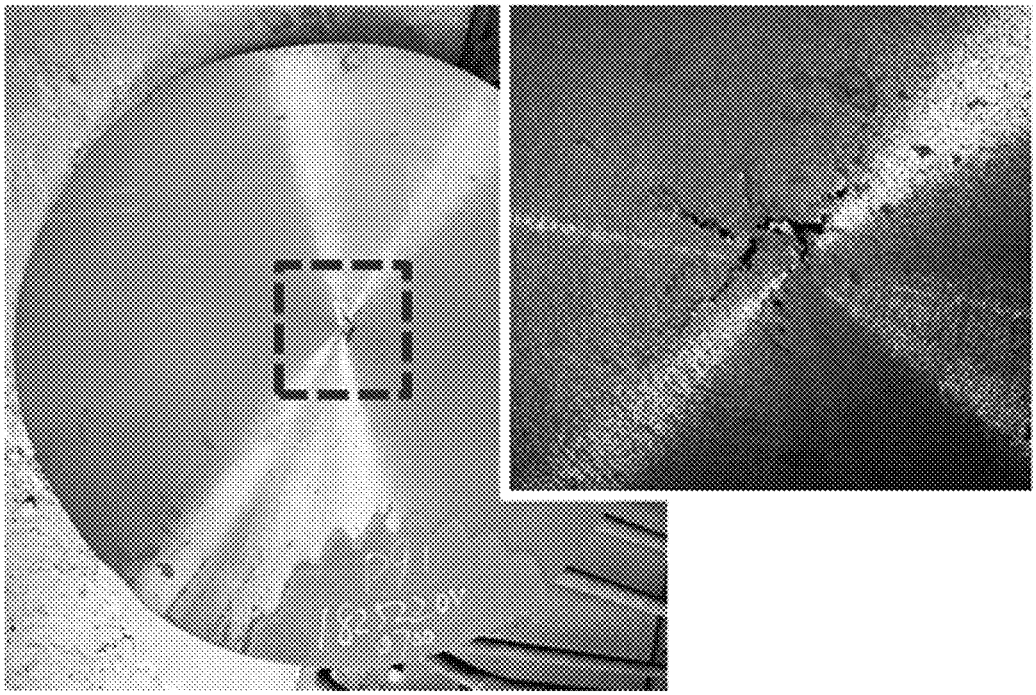
FIG. 1 (PRIOR ART)
FIG. 1 is a schematic diagram of defects of porosity and segregation in the prior art.
Figure 2:
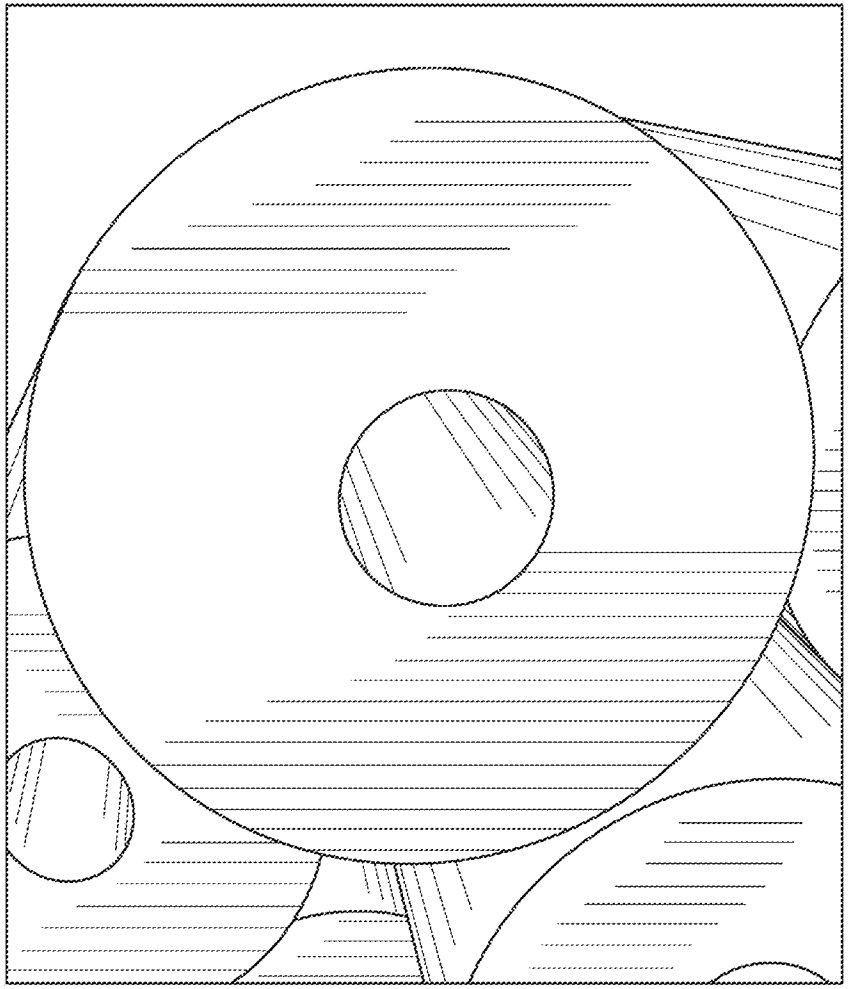
FIG. 2 (PRIOR ART)
FIG. 2 is a schematic diagram of round billets after being drilled in the prior art.

It should be noted that all directional indicators (such as upper, lower, left, right, front and rear) in the embodiment of the invention are only used to explain the relative positional relationship, movement, and the like. between various components under a certain specific posture (as shown in the drawings). If the specific posture changes, the directional indicator will also change accordingly.

Embodiment 1

Figure 3:
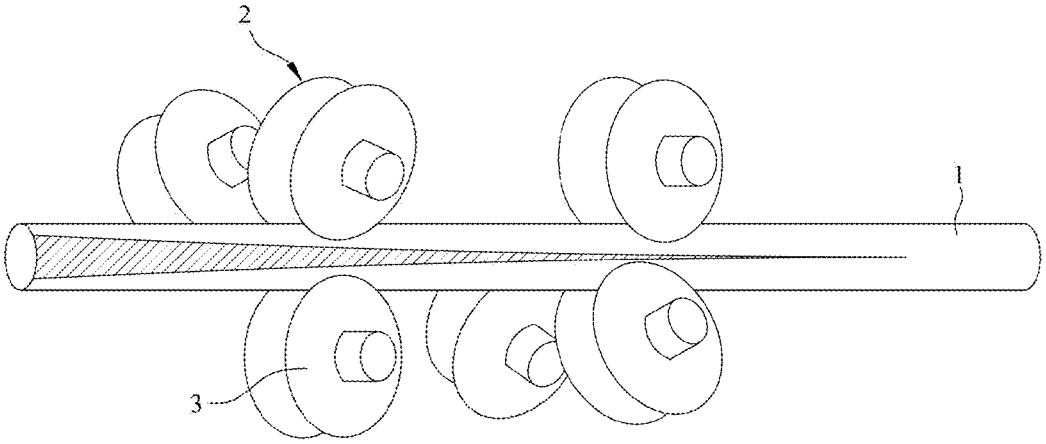
FIG. 3 is a schematic structural diagram of embodiment 1 of the present invention.
Figure 4:
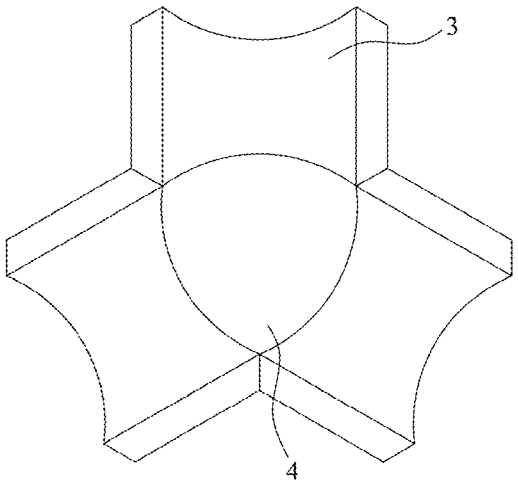
FIG. 4 is a schematic diagram of a round billet radial press-down device with an arc triangular forming hole according to embodiment 1 of the present invention.
Figure 5:
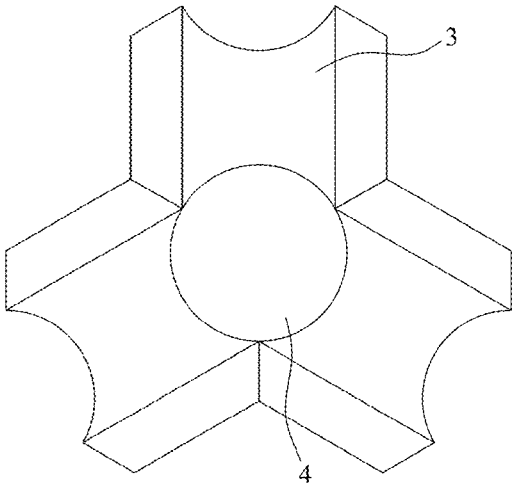
FIG. 5 is a schematic diagram of a round billet radial press-down device with a circular forming hole according to embodiment 1 of the present invention.
Figure 10:
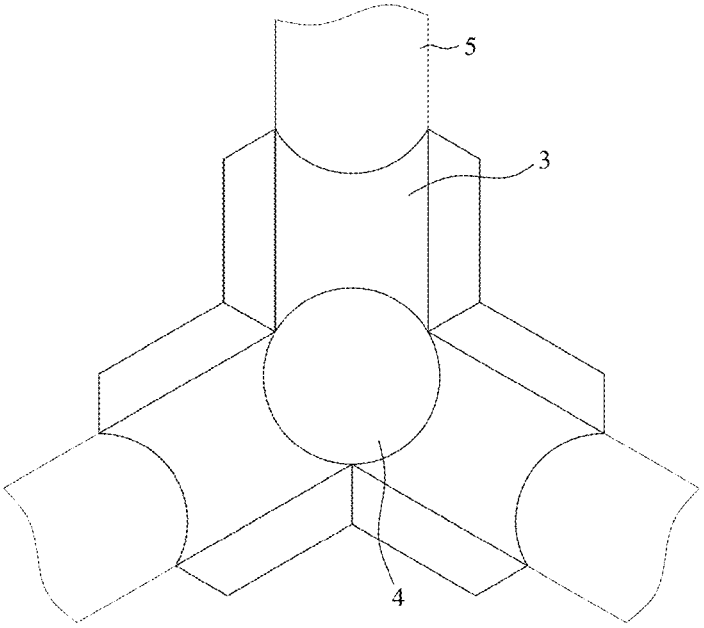
FIG. 10 is a schematic structural diagram of mounting of a water cutting plate.

As shown in FIGS. 3-5, the embodiment provides a device for achieving a core part press-down technology in a continuous casting round billet solidification process. The device for achieving a core part press-down technology in a continuous casting round billet solidification process comprises two round billet radial press-down devices 2. The two round billet radial press-down devices 2 are distributed along an axial straight line array of round billets 1 outside a press-down interval of the round billets 1, and the press-down interval is an area from 0.85 of a solid phase ratio of the round billets 1 to solidification end points (behind an effective secondary cooling area and in front of a pulling and straightening machine). Each round billet radial press-down device 2 comprises three press-down rollers 3 distributed along a circumference of a central axis of the round billets 1 in an array. Each press-down roller 3 is made of heat-resistant steel roller. A forming hole 4 for extruding the round billets 1 is formed between the three press-down rollers 3 of each round billet radial press-down device 2. The forming holes 4 of the round billet radial press-down devices 2 near forming ends of the round billets 1 are arc triangular, as shown in FIG. 4. The forming holes 4 near solidification ends of the round billets 1 are circular, as shown in FIG. 5. Two adjacent round billet radial press-down devices 2 are arranged in a manner of staggering by 180 degrees. An interval between the two adjacent round billet radial press-down devices 2 is 1 m. A water cutting plate 5 is arranged at an outer side of each press-down roller 3, as shown in FIG. 10. A shape of the water cutting plate 5 corresponds with a roller shape of each press-down roller 3. The press-down rollers 3 of each round billet radial press-down device 2 have a function of opening and closing along a radial direction of the round billets 1.

It should be noted that when one of the round billet radial press-down devices 2 is mounted near the solidification ends of the round billets 1, an electromagnetic stirring device at the end needs to be moved upward.

A method for achieving a core part press-down technology in a continuous casting round billet solidification process by using the aforementioned device for achieving the core part press-down technology in a continuous casting round billet solidification process, the method comprises the following steps:

Step 1: importing a material, a diameter and a casting speed of the round billets 1, a crystallizer water amount of a casting machine and a water amount of a secondary cooling zone into a finite element analysis software. In the embodiment, the diameter of the round billets 1 is 600 mm and the material is Q235 steel; the round billets 1 are cast by a full arc continuous casting machine at a casting speed of 0.22 m/s, with an arc radius of 14 m; and a target diameter of 570 mm; determining a solid phase ratio at a beginning of press-down to be 0.85 through a finite element analysis, and, determining a starting position and an ending position of a press-down interval;

Step 2: running the round billets 1 from an outlet of the casting machine to the round billet radial press-down devices 2 along an axial direction of the round billets, when the round billets 1 reach the round billet radial press-down devices 2, the round billets 1 start to be pressed down by the round billet radial press-down devices 2, and after all the round billets 1 pass through the round billet radial press-down devices 2, the press-down is stopped; and Step 3: spraying cooling water onto an outer surface of each press-down roller 3 to cool each press-down roller 3 during the press-down of the round billet radial press-down devices 2, and the cooling water after cooling flowing back to an equipment cooling water system of the casting machine along the water cutting plate 5 of each press-down roller 3 to prevent the cooling water from falling onto the surfaces of the round billets 1 and enable the round billets 1 to be rapidly cooled.

It should be noted that running of the round billet radial press-down devices 2 are controlled in synchronization with the casting machine to meet the normal operation of the casting machine, and a linear speed of each press-down roller 3 is not lower than a billet casting speed of the continuous casting machine.

A press-down rate of a single round billet radial press-down device 2 is 5%, and the total press-down rate of the device for achieving a core part press-down technology in a continuous casting round billet solidification process is 10%.

The continuous casting round billets 1 sequentially pass through a crystallizer, an effective secondary cooling zone and an air cooling zone to enter the press-down interval, and then sequentially pass through the two round billet radial press-down devices 2. The diameter of the continuous casting round billets 1 is reduced from 600 mm to 570 mm, and at this time, the continuous casting round billets 1 are completely solidified and are straightened by a pulling and straightening machine.

After the press-down treatment, a central porosity level is decreased from 2.0-1.5 to 1.0, and a central segregation level is less than 1.0.

Embodiment 2

Figure 6:
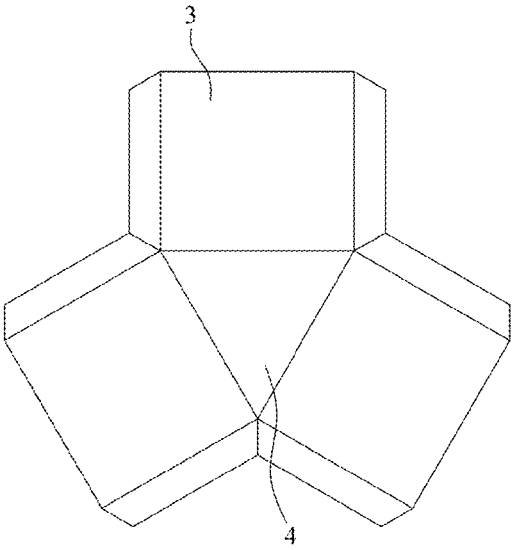
FIG. 6 is a schematic diagram of a round billet radial press-down device with a triangular forming hole according to embodiment 2 of the present invention.

The embodiment provides a device for achieving a core part press-down technology in a continuous casting round billet solidification process. The device for achieving a core part press-down technology in a continuous casting round billet solidification process comprises three round billet radial press-down devices 2. The three round billet radial press-down devices 2 are distributed along an axial straight line array of round billets 1 outside a press-down interval of the round billets 1, and the press-down interval is an area from 0.65 of a solid phase ratio of the round billets 1 to solidification end points (behind an effective secondary cooling area and in front of a pulling and straightening machine). Each round billet radial press-down device 2 comprises three press-down rollers 3 distributed along a circumference of a central axis of the round billets 1 in an array. Each press-down roller 3 is made of heat-resistant steel. A forming hole 4 for extruding the round billets 1 is formed between the three press-down rollers 3 of each round billet radial press-down device 2. The forming holes 4 of the round billet radial press-down devices 2 near forming ends of the round billets 1 are flat triangular, as shown in FIG. 6. The forming holes 4 near solidification ends of the round billets 1 are circular, as shown in FIG. 5. The forming holes 4 of the middle round billet radial press-down devices 2 are arc triangular. Two adjacent round billet radial press-down devices 2 are arranged in a manner of staggering by 180 degrees. The interval between the two adjacent round billet radial press-down devices 2 is 1 m A water cutting plate 5 is arranged at an outer side of each press-down roller 3. A shape of the water cutting plate 5 corresponds with a roller shape of each press-down roller 3. The press-down rollers 3 of each round billet radial press-down device 2 have a function of opening and closing along a radial direction of the round billets 1.

It should be noted that when one of the round billet radial press-down device 2 is mounted near the solidification ends of the round billets 1, an electromagnetic stirring device at the end needs to be moved upward.

A method for achieving a core part press-down technology in a continuous casting round billet solidification process by using the aforementioned device for achieving the core part press-down technology in a continuous casting round billet solidification process, the method comprises the following steps:

Step 1: importing a material, a diameter and a casting speed of the round billets 1, a crystallizer water amount of a casting machine and a water amount of a secondary cooling zone into a finite element analysis software. In the embodiment, the diameter of the round billets 1 is 360 mm and the material is Q345 steel; casting is performed at a casting speed of 0.8-1 m/s; and a target diameter of 300 mm; determining a solid phase ratio at a beginning of press-down to be 0.65 through a finite element analysis, and, determining a starting position and an ending position of a press-down interval;

Step 2: running the round billets 1 from an outlet of the casting machine to the round billet radial press-down devices 2 along an axial direction of the round billets, when the round billets 1 reach the round billet radial press-down devices 2, the round billets 1 start to be pressed down by the round billet radial press-down devices 2, and after all the round billets 1 pass through the round billet radial press-down devices 2, the press-down is stopped; and Step 3: spraying cooling water onto an outer surface of each press-down roller 3 to cool each press-down roller 3, during the press-down of the round billet radial press-down devices 2, and the cooling water after cooling flowing back to an equipment cooling water system of the casting machine along the water cutting plate 5 of each press-down roller 3 to prevent the cooling water from falling onto the surfaces of the round billets 1 and enable the round billets 1 to be rapidly cooled.

It should be noted that running of the round billet radial press-down devices 2 are controlled in synchronization with the casting machine to meet the normal operation of the casting machine, and a linear speed of each press-down roller 3 is not lower than a billet casting speed of the continuous casting machine.

A press-down rate of a single round billet radial press-down device 2 is 5.56%, and the total press-down rate of the device for achieving a core part press-down technology in a continuous casting round billet solidification process is 16.7%.

The continuous casting round billets 1 sequentially pass through a crystallizer, an effective secondary cooling zone and an air cooling zone to enter the press-down interval, and then sequentially pass through the two round billet radial press-down devices 2. The diameter of the continuous casting round billets 1 is reduced from 360 mm to 300 mm, and at this time, the continuous casting round billets 1 are completely solidified and are straightened by a pulling and straightening machine.

After the press-down treatment, through observation of macrostructure, the segregation in the core part of the billets is basically eliminated, and the segregation in ½ region and ¼ region is completely eliminated. A central porosity level is better than 0.5 and a shrinkage cavity does not exist.

Embodiment 3

Figure 7:
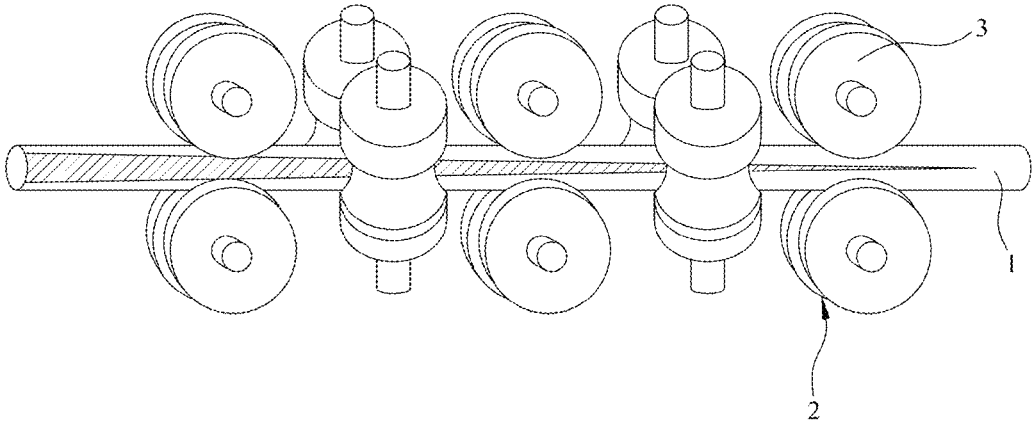
FIG. 7 is a schematic structural diagram of embodiment 3 of the present invention.
Figure 8:
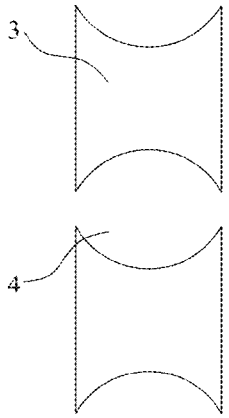
FIG. 8 is a schematic diagram of a round billet radial press-down device with an elliptic forming hole according to embodiment 3 of the present invention.
Figure 9:
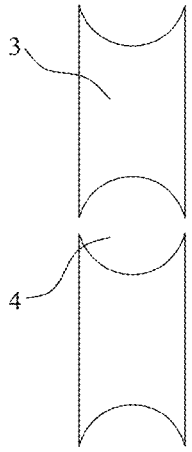
FIG. 9 is a schematic diagram of a round billet radial press-down device with a circular forming hole according to embodiment 3 of the present invention.

As shown in FIGS. 7-9, the embodiment provides a device for achieving a core part press-down technology in a continuous casting round billet solidification process. The device for achieving a core part press-down technology in a continuous casting round billet solidification process comprises four round billet radial press-down devices 2. The four round billet radial press-down devices 2 are distributed along an axial straight line array of round billets 1 outside a press-down interval of the round billets 1, and the press-down interval is an area from 0.75 of a solid phase ratio of the round billets 1 to solidification end points (behind an effective secondary cooling area and in front of a pulling and straightening machine). Each round billet radial press-down device 2 comprises two press-down rollers 3 distributed along a circumference of a central axis of the round billets 1 in an array. Each press-down roller 3 is made of heat-resistant steel. A forming hole 4 for extruding the round billets 1 is formed between the two press-down rollers 3 of each round billet radial press-down device 2. The forming holes 4 of the round billet radial press-down devices 2 near forming ends of the round billets 1 and the forming holes 4 of the round billet radial press-down devices 2 near solidification ends of the round billets 1 are formed in a gradual change manner from an elliptic to a circle. Specifically, the forming holes 4 of the three round billet radial press-down devices 2 near the forming ends of the round billets are elliptic, and the forming holes 4 of the round billet radial press-down devices 2 near the solidification ends of the round billets 1 are circular. Two adjacent round billet radial press-down devices 2 are arranged in a manner of staggering by 90 degrees. An interval between the two adjacent round billet radial press-down devices 2 is 1 m. A water cutting plate 5 is arranged at an outer side of each press-down roller 3. A shape of the water cutting plate 5 corresponds with a roller shape of each press-down roller 3. The press-down rollers 3 of each round billet radial press-down device 2 have a function of opening and closing along a radial direction of the round billets 1.

It should be noted that when one of the round billet radial press-down devices 2 is mounted near the solidification ends of the round billets 1, an electromagnetic stirring device at the end needs to be moved upward.

A method for achieving a core part press-down technology in a continuous casting round billet solidification process by using the aforementioned device for achieving the core part press-down technology in a continuous casting round billet solidification process, the method comprises the following steps:

Step 1: importing a material, a diameter and a casting speed of the round billets 1, a crystallizer water amount of a casting machine and a water amount of a secondary cooling zone into a finite element analysis software. In the embodiment, the diameter of the round billets 1 is 300 mm and the material is 15CrMo steel; casting is performed at a casting speed of 0.7-1 m/s; and a target diameter of 180 mm; determining a solid phase ratio at a beginning of press-down to be 0.75 through a finite element analysis, and determining a starting position and an ending position of a press-down interval;

Step 2: running the round billets 1 from an outlet of the casting machine to the round billet radial press-down devices 2 along an axial direction of the round billets, when the round billets 1 reach the round billet radial press-down devices 2, the round billets 1 start to be pressed down by the round billet radial press-down devices 2, and after all the round billets 1 pass through the round billet radial press-down devices 2, the press-down is stopped; and Step 3: spraying cooling water onto an outer surface of each press-down roller 3 to cool each press-down roller 3, during the press-down of the round billet radial press-down devices 2, and the cooling water after cooling flowing back to an equipment cooling water system of the casting machine along the water cutting plate 5 of each press-down roller 3 to prevent the cooling water from falling onto the surfaces of the round billets 1 and enable the round billets 1 to be rapidly cooled.

It should be noted that running of the round billet radial press-down devices 2 are controlled in synchronization with the casting machine to meet the normal operation of the casting machine, and a linear speed of each press-down roller 3 is not lower than a billet casting speed of the continuous casting machine.

A press-down rate of a single round billet radial press-down device 2 is 10%, and the total press-down rate of the device for achieving a core part press-down technology in a continuous casting round billet solidification process is 40%.

The continuous casting round billets 1 sequentially pass through a crystallizer, an effective secondary cooling zone and an air cooling zone to enter the press-down interval, and then sequentially pass through the two round billet radial press-down devices 2. The diameter of the continuous casting round billets 1 is reduced from 300 mm to 180 mm, and at this time, the continuous casting round billets 1 are completely solidified and are straightened by a pulling and straightening machine.

After the press-down treatment, through observation of macrostructure, a central porosity level is reduced to 1.5 or below, and a central segregation level is reduced to 1.0 or below.

Embodiment 4

The embodiment provides a device for achieving a core part press-down technology in a continuous casting round billet solidification process. The device for achieving a core part press-down technology in a continuous casting round billet solidification process comprises five round billet radial press-down devices 2. The five round billet radial press-down devices 2 are distributed along an axial straight line array of round billets 1 outside a press-down interval of the round billets 1, and the press-down interval is an area from 0.65 of a solid phase ratio of the round billets 1 to solidification end points (behind an effective secondary cooling area and in front of a pulling and straightening machine). Each round billet radial press-down device 2 comprises two press-down rollers 3 distributed along a circumference of a central axis of the round billets 1 in an array. Each press-down roller 3 is made of heat-resistant steel. A forming hole 4 for extruding the round billets 1 is formed between the two press-down rollers 3 of each round billet radial press-down device 2. The forming holes 4 of the round billet radial press-down devices 2 near the forming ends of the round billets 1 and the forming holes 4 of the round billet radial press-down devices 2 near the solidification ends of the round billets 1 are formed in a gradual change manner from an elliptic to a circle. Specifically, the forming holes 4 of the three round billet radial press-down devices 2 near the forming ends of the round billets are elliptic, and the forming holes 4 of the round billet radial press-down devices 2 near the solidification ends of the round billets 1 are circular. Two adjacent round billet radial press-down devices 2 are arranged in a manner of staggering by 90 degrees. An interval between the two adjacent round billet radial press-down devices 2 is 1 m. A water cutting plate 5 is arranged at an outer side of each press-down roller 3. A shape of the water cutting plate 5 corresponds with a roller shape of each press-down roller 3. The press-down rollers 3 of each round billet radial press-down device 2 have a function of opening and closing along a radial direction of the round billets 1.

It should be noted that when one of the round billet radial press-down devices 2 is mounted near the solidification ends of the round billets 1, an electromagnetic stirring device at the end needs to be moved upward.

A method for achieving a core part press-down technology in a continuous casting round billet solidification process by using the aforementioned device for achieving the core part press-down technology in a continuous casting round billet solidification process, the method comprises the following steps:

Step 1: importing a material, a diameter and a casting speed of the round billets 1, a crystallizer water amount of a casting machine and a water amount of a secondary cooling zone into a finite element analysis software. In the embodiment, the diameter of the round billets 1 is 200 mm and the material is Q235B steel; casting is performed at a casting speed of 0.8-1.3 m/s; and a target diameter of 80 mm; determining a solid phase ratio at a beginning of press-down to be 0.65 through a finite element analysis, and determining a starting position and an ending position of a press-down interval;

Step 2: running the round billets 1 from an outlet of the casting machine to the round billet radial press-down devices 2 along an axial direction of the round billets, when the round billets 1 reach the round billet radial press-down devices 2, the round billets 1 start to be pressed down by the round billet radial press-down devices 2, and after all the round billets 1 pass through the round billet radial press-down devices 2, the press-down is stopped; and Step 3: spraying cooling water onto an outer surface of each press-down roller 3 to cool each press-down roller 3, during the press-down of the round billet radial press-down devices 2, and the cooling water after cooling flowing back to an equipment cooling water system of the casting machine along the water cutting plate 5 of each press-down roller 3 to prevent the cooling water from falling onto the surfaces of the round billets 1 and enable the round billets 1 to be rapidly cooled.

It should be noted that running of the round billet radial press-down devices 2 are controlled in synchronization with the casting machine to meet the normal operation of the casting machine, and a linear speed of each press-down roller 3 is not lower than a billet casting speed of the continuous casting machine.

A press-down rate of a single round billet radial press-down device 2 is 12%, and the total press-down rate of the device for achieving a core part press-down technology in a continuous casting round billet solidification process is 60%.

The continuous casting round billets 1 sequentially pass through a crystallizer, an effective secondary cooling zone and an air cooling zone to enter the press-down interval, and then sequentially pass through the two round billet radial press-down devices 2. The diameter of the continuous casting round billets 1 is reduced from 200 mm to 80 mm, and at this time, the continuous casting round billets 1 are completely solidified and are straightened by a pulling and straightening machine.

After the press-down treatment, through observation of macrostructure, a central porosity level and a central segregation level are both reduced to 1.0 or below.

The above embodiments are only used to illustrate without limiting the technical solution of the invention. Although the invention has been described in detail with reference to the above embodiments, it should be understood by those skilled in the art that modifications or equivalent substitutions can still be made to the specific embodiments of the invention without departing from the spirit and scope of the invention, which should be covered by the scope of the claims.

What is claimed is:

1. A device for achieving a core part press-down technology in a continuous casting round billet solidification process, comprising a plurality of round billet radial press-down devices distributed along an axial array of round billets outside a press-down interval of the round billets, and the press-down interval being an area from 0.65 of a solid phase ratio of the round billets to solidification end points;

wherein each round billet radial press-down device comprises three press-down rollers distributed along a circumference of a central axis of the round billets in an array; a forming hole for extruding the round billets is formed between the three press-down rollers of each round billet radial press-down device; and forming holes of the round billet radial press-down devices near forming ends of the round billets and the forming holes of the round billet radial press-down devices near solidification ends of the round billets are formed in a gradual change manner from a triangle to a circle;

wherein two adjacent round billet radial press-down devices are arranged in a manner of staggering by 180 degrees;

wherein a water cutting plate is arranged at an outer side of each press-down roller, and a shape of the water cutting plate corresponds with a roller shape of each press-down roller; and wherein the press-down rollers of each round billet radial press-down device have a function of opening and closing along a radial direction of the round billets.

2. The device according to claim 1, wherein a total number of the round billet radial press-down devices are two to five.

3. The device according to claim 1, wherein each press-down roller is made of heat-resistant steel.

4. A method for achieving a core part press-down technology in a continuous casting round billet solidification process by using the device for achieving the core part press-down technology in the continuous casting round billet solidification process according to claim 1, the method comprising the following steps:

step 1: importing a material, a diameter and a casting speed of each of the round billets, a crystallizer water amount of a casting machine and a water amount of a secondary cooling zone into a finite element analysis software; determining a solid phase ratio at a beginning of press-down through a finite element analysis, and determining a starting position and an ending position of a press-down interval;

step 2: running the round billets from an outlet of the casting machine to the round billet radial press-down devices along an axial direction of the round billets, when the round billets reach the round billet radial press-down devices, the round billets start to be pressed down by the round billet radial press-down devices, and after all the round billets pass through the round billet radial press-down devices, the press-down is stopped; and step 3: spraying cooling water onto an outer surface of each press-down roller to cool each press-down roller during the press-down of the round billet radial press-down devices, and the cooling water after cooling flowing back to an equipment cooling water system of the casting machine along the water cutting plate of each press-down roller.

5. The method according to claim 4, wherein a press-down rate of a single round billet radial press-down device is 5%-40%, and a total press-down rate of the device for achieving a core part press-down technology in a continuous casting round billet solidification process is 10%-60%.

6. A device for achieving a core part press-down technology in a continuous casting round billet solidification process, comprising a plurality of round billet radial press-down devices distributed along an axial array of round billets outside a press-down interval of the round billets, and the press-down interval being an area from 0.65 of a solid phase ratio of the round billets to solidification end points;

wherein each round billet radial press-down device comprises two press-down rollers distributed along a circumference of a central axis of the round billets in an array; a forming hole for extruding the round billets is formed between the two press-down rollers of each round billet radial press-down device; and forming holes of the round billet radial press-down devices near forming ends of the round billets and forming holes of the round billet radial press-down devices near solidification ends of the round billets are formed in a gradual change manner from an elliptic to a circle;

wherein two adjacent round billet radial press-down devices are arranged in a manner of staggering by 90 degrees;

wherein a water cutting plate is arranged at an outer side of each press-down roller, and a shape of the water cutting plate corresponds with a roller shape of each press-down roller; and wherein the press-down rollers of each round billet radial press-down device have a function of opening and closing along a radial direction of the round billets.

7. The device according to claim 6, wherein a total number of the round billet radial press-down devices are two to five.

8. The device according to claim 6, wherein each press-down roller is made of heat-resistant steel.

9. A method for achieving a core part press-down technology in a continuous casting round billet solidification process by using the device for achieving the core part press-down technology in the continuous casting round billet solidification process according to claim 6, the method comprising the following steps:

step 1: importing a material, a diameter and a casting speed of each of the round billets, a crystallizer water amount of a casting machine and a water amount of a secondary cooling zone into a finite element analysis software; determining a solid phase ratio at a beginning of press-down through a finite element analysis, and determining a starting position and an ending position of a press-down interval;

step 2: running the round billets from an outlet of the casting machine to the round billet radial press-down devices along an axial direction of the round billets, when the round billets reach the round billet radial press-down devices, the round billets start to be pressed down by the round billet radial press-down devices, and after all the round billets pass through the round billet radial press-down devices, the press-down is stopped; and step 3: spraying cooling water onto an outer surface of each press-down roller to cool each press-down roller during the press-down of the round billet radial press-down devices, and the cooling water after cooling flowing back to an equipment cooling water system of the casting machine along the water cutting plate of each press-down roller.

10. The method according to claim 9, wherein a press-down rate of a single round billet radial press-down device is 5%-40%, and a total press-down rate of the device for achieving a core part press-down technology in a continuous casting round billet solidification process is 10%-60%.

* * * * *